United States Patent [19]

Champion

[11] 4,058,868

[45] Nov. 22, 1977

[54] CAPSULE CLEANING AND POLISHING

[75] Inventor: Robert J. Champion, Greenville, S.C.

[73] Assignee: Perry Industries, Inc., Hicksville, N.Y.

[21] Appl. No.: 694,789

[22] Filed: June 10, 1976

[51] Int. Cl.[2] ..... B08B 7/04

[52] U.S. Cl. ..... 15/4; 15/3.16; 15/305; 15/306 B; 209/250

[58] Field of Search ..... 15/4, 3.16, 97 R, 21 A, 15/21 R, 21 B, 21 C, 21 D, 305, 306; 134/1, 6, 21; 209/250

[56] References Cited

U.S. PATENT DOCUMENTS

| | | | |
|---|---|---|---|
| 2,425,984 | 8/1947 | Blackman | 15/4 X |
| 2,590,381 | 3/1952 | Currie | 15/3.16 X |
| 2,789,694 | 4/1957 | Hills | 209/250 |
| 3,592,689 | 7/1971 | Chaplinski | 15/3.16 X |
| 3,685,651 | 8/1972 | Gruber | 209/250 |

*Primary Examiner*—Edward L. Roberts
*Attorney, Agent, or Firm*—Koenig, Senniger, Powers and Leavitt

[57] ABSTRACT

An apparatus and a method of cleaning and polishing capsules in which the capsules are blown against one side of an electrically charged screen to clean dust therefrom by their impacting on the screen. Air is drawn through the screen from the other side of the screen to draw off the dust through the screen. The capsules drop down from the screen and are delivered to a rotating inclined drum having a lining of napped fabric wherein the capsules are tumbled for residual cleaning and polishing.

14 Claims, 11 Drawing Figures

CAPSULE CLEANING AND POLISHING

BACKGROUND OF THE INVENTION

This invention relates to the cleaning and polishing of capsules and more particularly to apparatus for and a method of cleaning and polishing filled capsules.

When capsules are filled with finely divided materials, e.g., pharmaceuticals in the form of powder, the operation is inherently such that the capsules may become covered with dust, and this must be removed before the capsules are packaged for sale. Heretofore, the capsules have been cleaned and polished in one of three ways: (1) by hand polishing on large sheets of cheesecloth; (2) by tumbling them in a drum containing salt; or (3) in apparatus wherein the capsules drop onto a vibrating sieve, being fed by vibration over the sieve and thence between a pair of moving lambswool belts. The first of these is labor intensive, and the cleaning and polishing may not be uniform. The second accomplishes good cleaning and polishing, but requires large quantities of salt, and is thereby relatively expensive. The third has not been completely satisfactory for removing powder from the capsules, particularly from the crevice around the body of the capsule at the end of the cap of the capsule and from the ends of the capsule, and the use of the lambswool belts is relatively expensive.

SUMMARY OF THE INVENTION

Among the several objects of this invention may be noted the provision of improved apparatus for and a method of cleaning and polishing capsules which effectively and economically removes dust from the capsules, including the crevice at the end of the cap of the capsule and the ends of the capsule, and the provision of such an apparatus which is itself readily cleaned.

In general, apparatus of this invention comprises a screen positioned to have capsules impelled against one side thereof for dislodging dust from the capsules and to have the capsules drop down from the screen after impacting against it, means for impelling capsules against said one side of the screen, means for drawing air through the screen from the other side thereof to draw off dust through the screen, and means for buffing the capsules after they have dropped down from the screen for removing any residual dust from the capsules and polishing them. The method generally comprises impelling the capsules against one side of a screen to clean dust therefrom by their impacting on the screen, drawing air through the screen from the other side thereof to draw off the dust through the screen, and then buffing the capsules with a napped fabric.

Other objects and features will be in part apparent and in part pointed out hereinafter.

BRIEF DESCRIPTION OF THE DRAWINGS

Corresponding reference characters indicate corresponding parts throughout the several views of the drawings.

Description of the Preferred Embodiment

Figure 7:
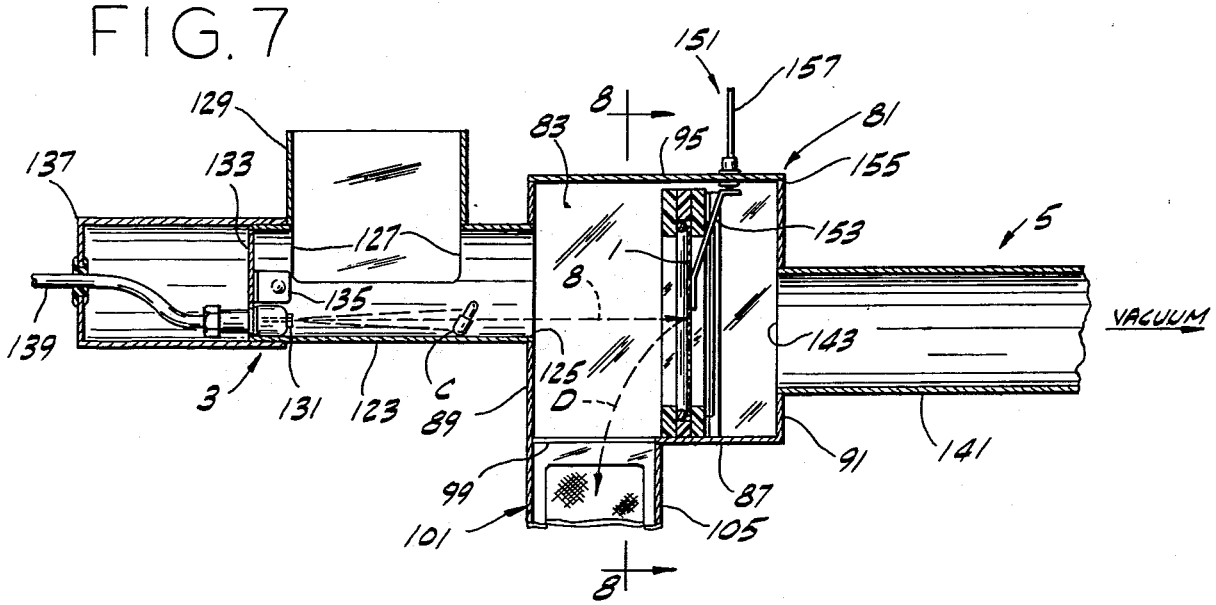
FIG. 7 is an enlarged section generally on line 7—7 of FIG. 1.
Figure 8:
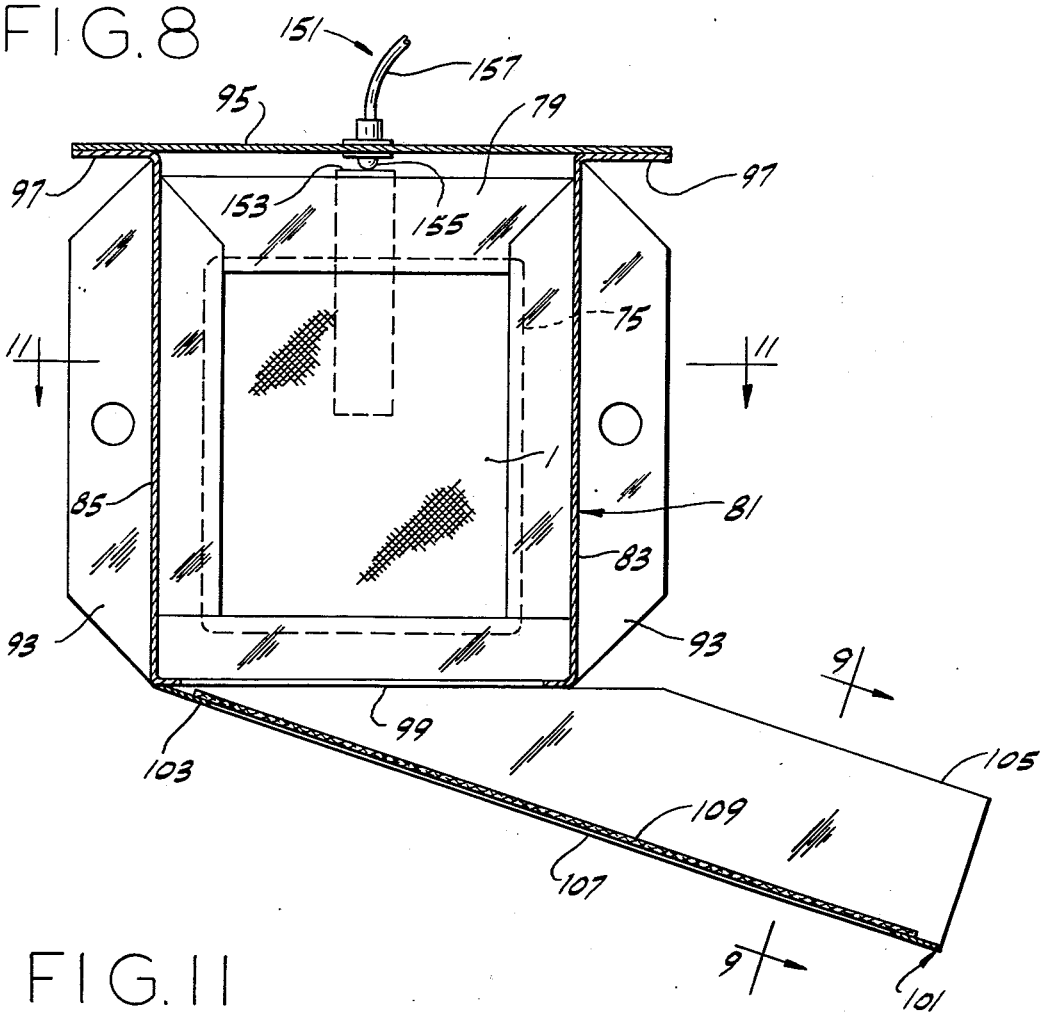
FIG. 8 is an enlarged section generally on line 8—8 of FIG. 7.
Figure 11:
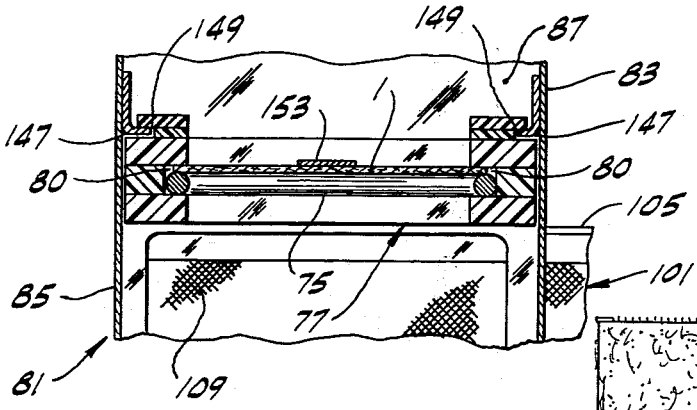
FIG. 11 is a section generally on line 11—11 of FIG. 8.

Referring to the drawings, a capsule cleaning and polishing apparatus of this invention is shown to comprise a screen 1 (see FIGS. 5 and 7) positioned to have capsules C (filled capsules) impelled against one side thereof for dislodging dust from the capsules and to have the capsules drop down from the screen after impacting against it. At 3 is generally indicated means for impelling capsules by blowing them against said one side of the screen. At 5 is generally indicated means for drawing air through the screen from the other side of the screen to draw off dust through the screen. And at 7 is generally indicated means for buffing the capsules after they have dropped down from the screen for removing any residual dust from the capsules and polishing them.

Figure 2:
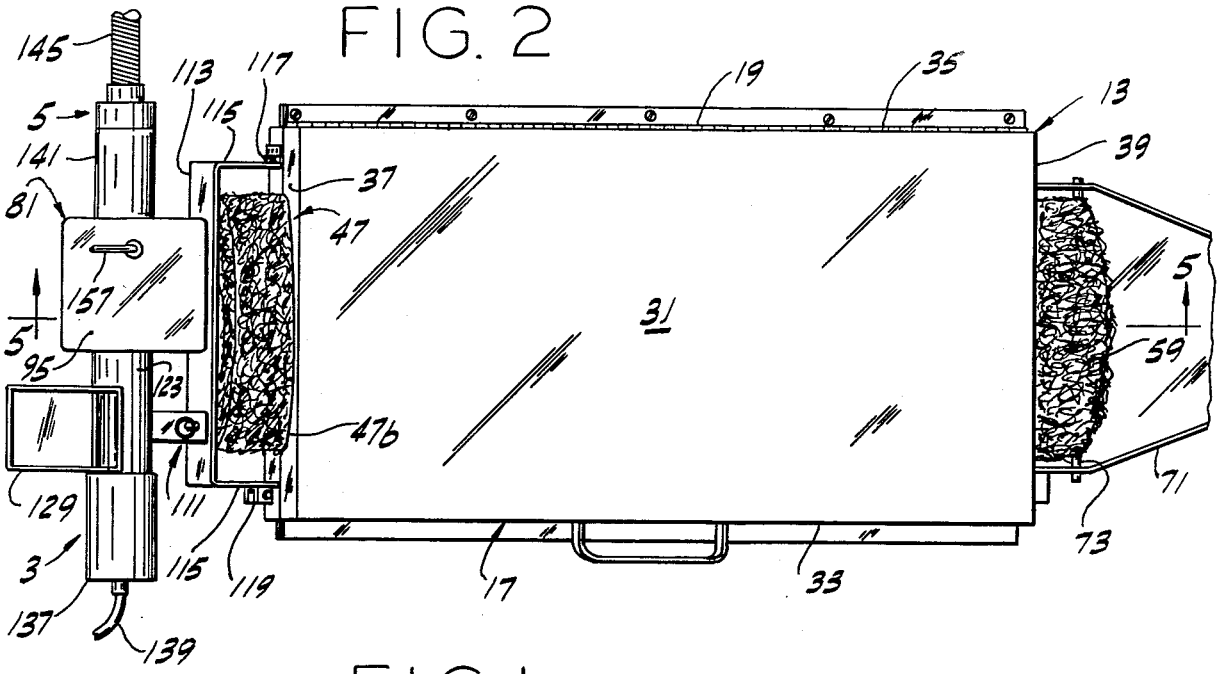
FIG. 2 is a plan of FIG. 1.
Figure 1:
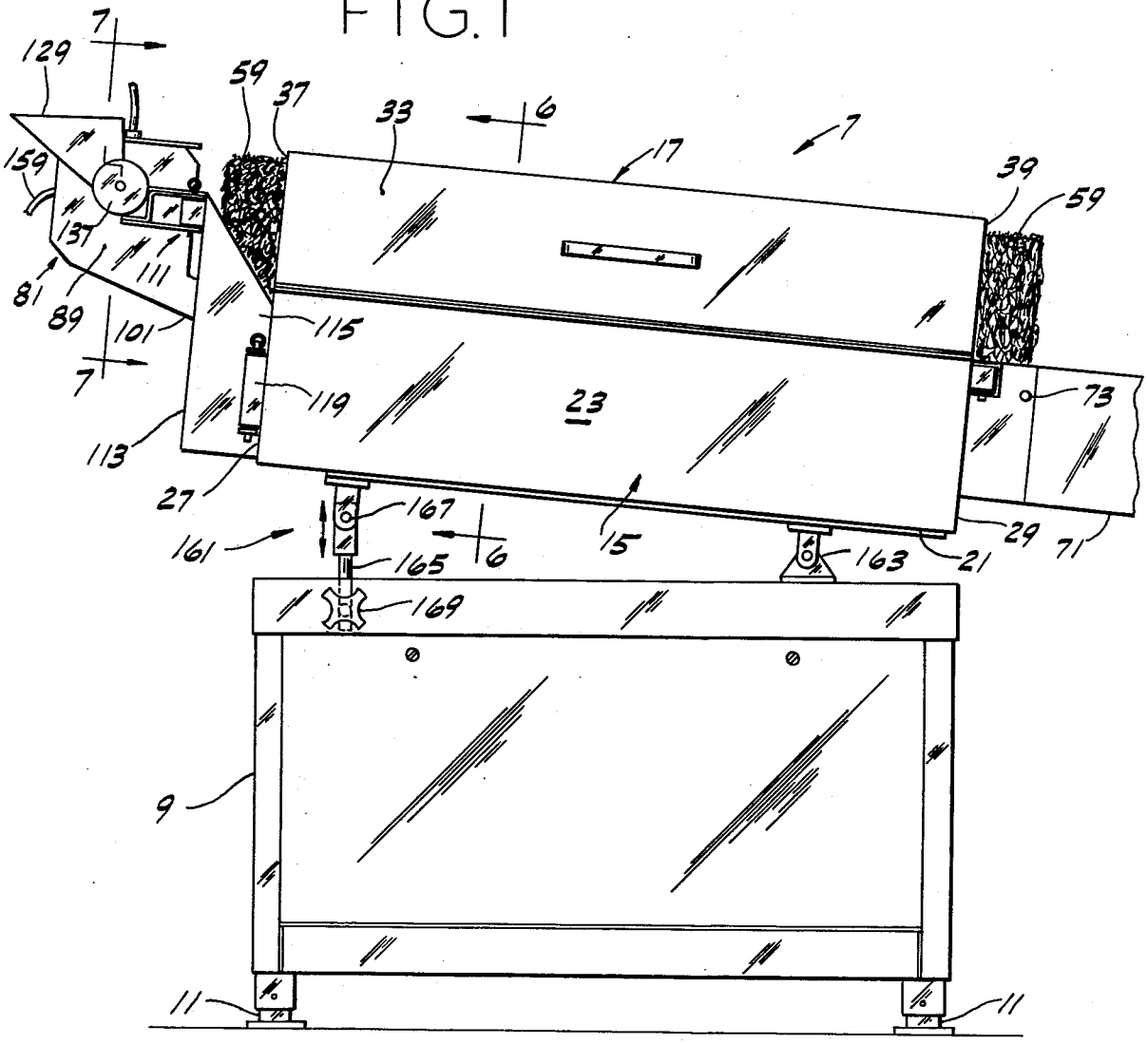
FIG. 1 is a view in side elevation of a capsule cleaning and polishing apparatus of this invention.
Figure 3:
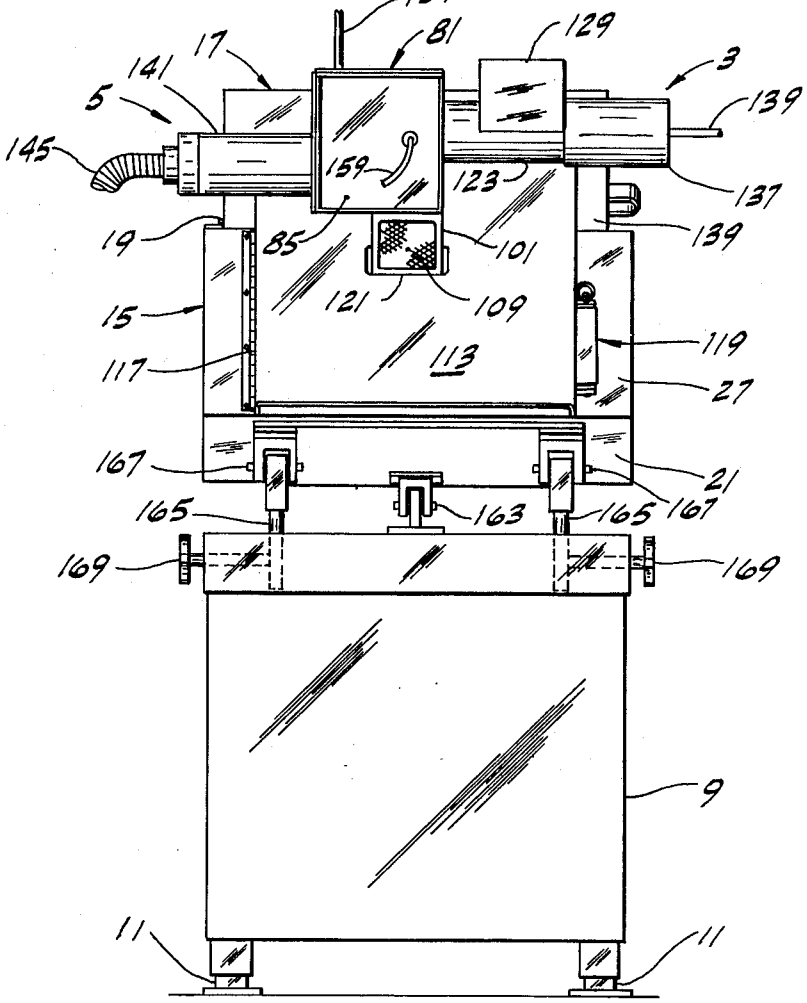
FIG. 3 is a left end elevation of FIG. 1.

More particularly, the apparatus comprises a base constituted by a cabinet 9 on legs 11 (see FIGS. 1, 3 and 4), which may be suitably adjustable, and a buffer drum housing generally designated 13 mounted on top of the cabinet. The housing 13 is generally in the form of a box having a body 15 and a lid 17 hinged at 19 to the body to swing between a closed position on the body and an open position for access to the interior of the housing. The body has a bottom 21, front and back side walls 23 and 25, and end walls 27 and 29. As to the latter, end wall 27 may be referred to as the entry end wall and end wall 29 may be referred to as the exit end wall. The lid 17 comprises a top wall 31, front and back side walls 33 and 35 and entry and exit end walls 37 and 39. The hinge 19 is at the upper edge of the back wall of the box body 15 and the lower edge of the back wall of the lid 17.

The buffing means comprises an open-ended cylindrical buffer drum 41 extending longitudinally of the housing 13, supported on two pairs of cradle rollers 43 journalled in bearings 45 mounted on the bottom 21 of the body 15 for rotation on an axis A which extends longitudinally of the housing generally in the central vertical plane of the housing and generally parallel to the bottom 21 of the body 15. This drum, which comprises a relatively thin-walled tube of stainless steel, for example, is longer than the housing and has its ends extending through circular openings 47 in the ends of the housing formed by semicircular recesses **47*a* and in the entry end walls 27 and 37 of the body 15 and lid 17 and semicircular recesses 47*b* in the exit end walls 37 and 39 of the body and lid. One of the cradle rollers, which is specially designated 43*a*, is adapted positively to be driven to rotate the drum 41 in counterclockwise direction as viewed in FIG. 4 by an electric motor 49 mounted on the bottom 21 of body 15**.

The buffer drum housing 13 is mounted on top of the base cabinet 9 in inclined position extending downwardly from the entry (left) end of the housing toward the exit (right) end of the housing, so that the drum 41 is inclined downwardly from its end (its entry end) at the entry end of the housing toward its exit end at the exit end of the housing. The cradle rollers 43 have annular peripheral grooves as indicated at 51 and the drum has a pair of peripheral rubber rings or tires 53 secured as by cementing to its exterior riding in the grooves.

Figure 10:
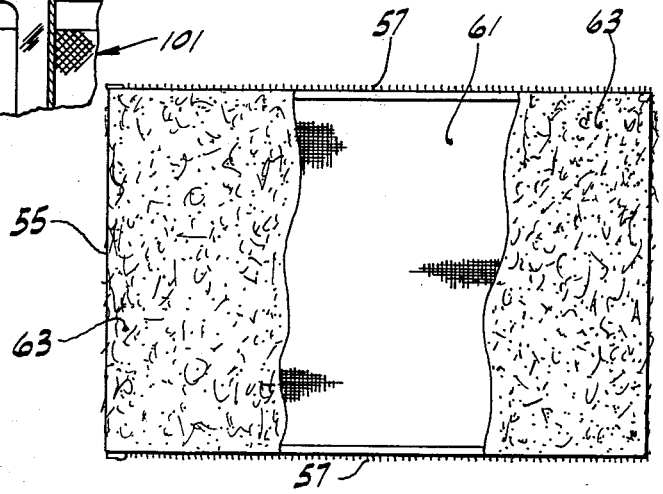
FIG. 10 is a view showing a drum lining.

The drum or tube 41 has a napped fabric lining generally designated 55. This is formed of a rectangular piece (see FIG. 10) of polyester pile fabric, such as that sold under the trademark "Kodel" by Eastman Chemical Products, Inc., having a width corresponding generally to the internal circumference of the drum or tube and a length somewhat greater than the length of the drum or tube and, means 57, more particularly a slide fastener, for fastening together the longitudinal edges of the piece of fabric to form it into a tube fitting in the drum with the ends of the fabric tube cuffed back as indicated at 59 on the outside of the drum at its ends. The polyester pile fabric has a backing 61 and a relatively thick pile 63, and the slide fastener components are secured to the longitudinal edges of the backing 61. The fabric, formed into a tube, is fitted in the drum with the pile 63 on the inside of the fabric tube for rubbing capsules.

Figure 4:
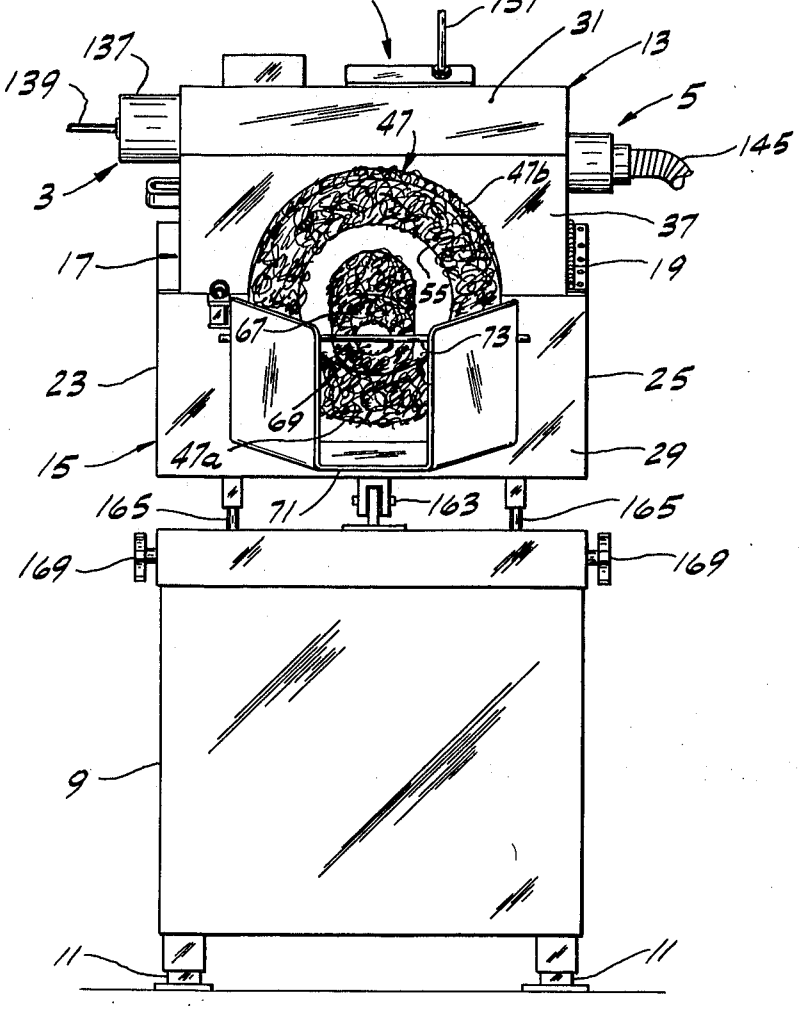
FIG. 4 is a right end elevation of FIG. 1.
Figure 5:
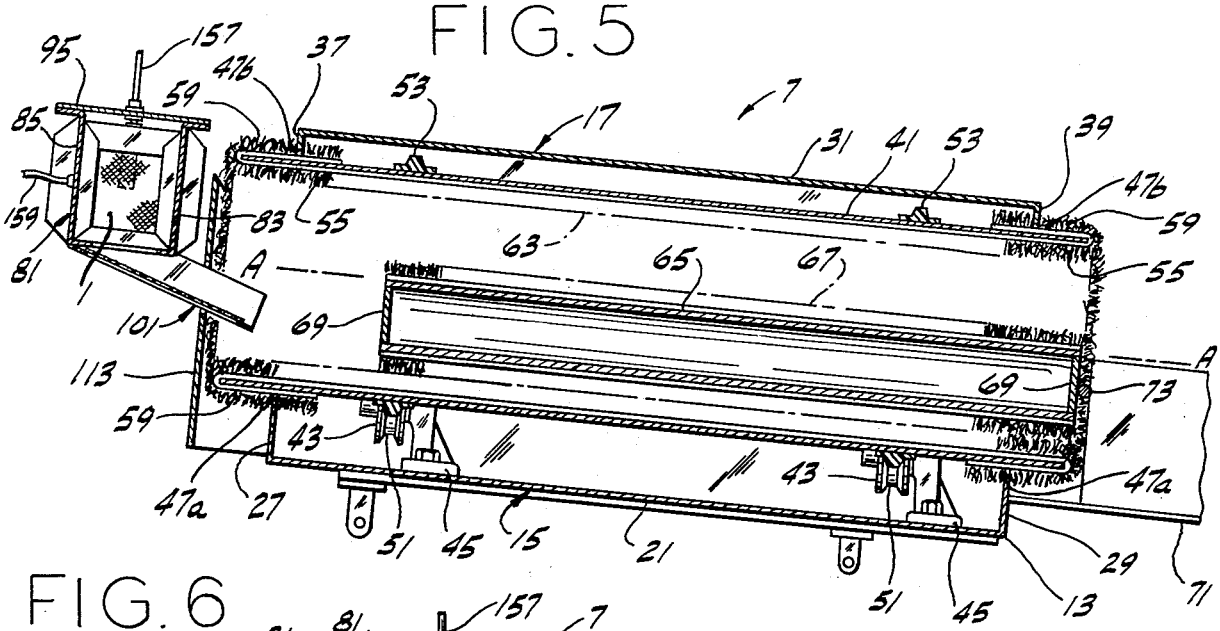
FIG. 5 is a longitudinal section generally on line 5—5 of FIG. 2 of the upper part of the apparatus only.
Figure 6:
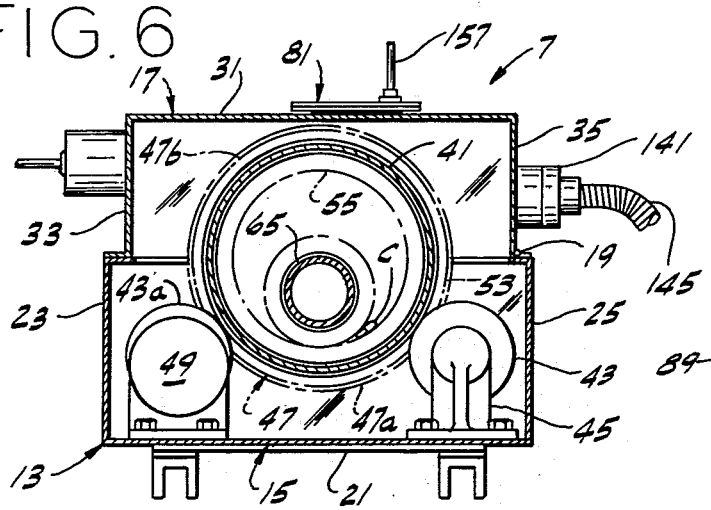
FIG 6 is a transverse section generally on line 6—6 of FIG. 1.
Figure 9:
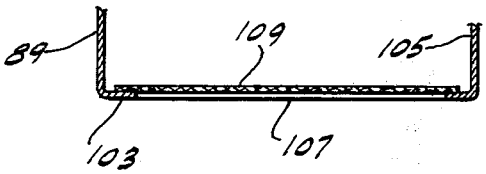
FIG. 9 is a section on line 9—9 of FIG. 8.

FIGS. 4–6 show a relatively small-diameter cylinder 65 having a jacket 67 of a napped fabric, which may be the same polyester pile fabric as the drum lining 55. This cylinder, which is shorter than the drum, rides freely in the drum and is useful in obtaining an enhanced buffing action on capsules. It may be a cardboard tube provided with end closures 69. The jacket 67 may consist of a rectangular piece of the same fabric as the drum lining 55, having a length generally equal to the length of the cylinder and a width corresponding to the circumference of the cylinder, with a slide fastener for fastening together its longitudinal edges to form it into a tube around the cylinder. The exit end wall 29 of the body 15 of the drum housing 13 carries a capsule exit chute 71 for delivery of cleaned and polished capsules from the drum 41, and the lower end of the cylinder 65 engages a rod 73 extending across this chute to keep the cylinder in the drum 41.

The screen 1 comprises a rectangular piece of wire cloth, e.g., stainless steel wire cloth woven of 0.025 inch wire with 10 meshes per inch, having a rim 75 formed for example of stainless steel rod, the screen being soldered to the rod. The screen with its rim is removably mounted in a rectangular frame 77, which may be made of suitable plastic such as "Plexiglass." The top of this frame, which is indicated at 79, is removable from the sides of the frame for fitting the screen in the frame and removing it from the frame, the sides of the rim 75 of the screen being slidable in grooves 80 in the sides of the frame.

The frame 77 carrying the screen 1 is removably mounted in a screen housing 81 adjacent the upper (entry) end of the drum 41. This housing has an inner wall 83 toward the upper end of the drum, an outer wall 85 and a partial bottom 87 extending between these walls at their lower ends. Walls 83 and 85 and the partial bottom 87 may be formed in one piece of sheet metal. The housing further has right and left end walls 89 and 91 (right and left as viewed in the direction of flow of capsules down the drum 41). These walls, which may be referred to as the entry and exit end walls of the screen housing, are suitably removably mounted against side flanges such as indicated at 93 on the walls 83 and 85. A cover 95 for the screen housing is suitably removably mounted on top flanges 97 on the walls 83 and 85.

The partial bottom 87 of the screen housing extends from the exit end wall 91 about half way toward the wall 89. The screen frame 77 fits in the screen housing 81 extending transversely of the housing from wall 83 to wall 85 at the inner end of the bottom 87. The latter being only partial, the housing thereby has an opening 99 at the bottom with this opening on the side of the screen 1 toward the entry end wall 89 of the housing. By means of the frame 77, the screen is mounted in the housing 81 in an upright position above the bottom of the housing, and thus at a level above the opening 99 (which constitutes a delivery passage) and at one side of opening 99, with one side of the screen (its left side as viewed in FIG. 7) facing in the direction toward opening 99. With this arrangement, capsules blown over the opening 99 against the screen from said side of the screen drop down through the opening 99. An inclined chute 101 extends from under the opening 99 into the upper end of the drum 41 for delivery of capsules dropping down through opening 99 into the drum at the upper end of the drum. This chute comprises an inclined bottom member 103 which may be formed integrally with the wall 89 and an upturned side 105 on member 103. Member 103 preferably has a relatively large opening 107 spanned by a screen 109. The screen housing 81 is suitably removably mounted as indicated at 111 on a bracket 113 which in turn is mounted on the entry end wall 27 of the body 15 of the drum housing 13. This bracket 113 comprises a plate having side flanges 115, one of which is hinged to wall 27 as indicated at 117, suitable latch means such as indicated at 119 being provided for latching the other flange to wall 27. The chute 101 extends through an opening 121 in the bracket 113, sloping downwardly into the drum 41 at its upper end as shown in FIG. 5.

The means 3 for blowing capsules C against the screen 1 comprises a duct 123 at the right side of the screen housing 81 opening into the housing via an opening 125 in the wall 89 of the housing. The duct 123 is constituted by a tube having its inner end suitably secured and sealed to the wall 89 around the opening 125. The duct has a top entrance opening at 127 for capsules to fall into the duct, and is fitted with a funnel 129 for funnelling capsules into the duct. This funnel may be suitably removably mounted on the duct (for cleaning purposes). An air nozzle 131 is mounted in the duct outward of the capsule entrance opening 127 directed to blow air through the duct into the screen housing. The nozzle is mounted in a disk 133 removably fitted in the end of the duct by means of a spring clip 135 on the disk. A removable cover for the outer end of the duct is indicated at 137. Air for the nozzle is supplied from a suitable source (not shown) through a line 139 extending through the cover.

The means 5 for drawing air through the screen 1 comprises a vacuum duct 141 at the left side of the screen housing in communication with the housing on the opposite side of the screen from the duct 123 via an opening 143 in the wall 91 of the housing. A vacuum hose 145 connects this vacuum duct to a suitable means for drawing air from the duct and delivering it to a suitable dust collection system (e.g., a filter, such as a dust bag, connected to the inlet of an air compressor or blower). The screen frame 77 extends not only from wall 83 to wall 85 but generally from the bottom 87 to the top 95 of the screen housing. Thus, drawing air out of the vacuum duct results in air being drawn through the screen. Walls 83 and 85 of the housing have vertical guides 147 received in grooves 149 in the sides of the screen frame, the latter being slidable in respect to these guides.

Means indicated generally at 151 is provided for electrically charging the screen 1. This comprises a leaf spring electrical contact 153 on the screen and an electrical terminal 155 extending down from the screen housing cover 95 when the cover is in place on the housing. A conductor 157 extends to the terminal 155 from one side of a relatively high voltage line (not shown), e.g., a 5000 volt line, and a conductor 159 extending from the other side of the high voltage line is connected, for exmple, to wall 85 of the screen housing 81.

The buffer drum housing 13 is mounted on the cabinet 9 for adjustment of its angle of inclination to the horizontal and thus for adjustment of the angle of inclination of the drum 41 by supporting means indicated generally at 161. This comprises means 163 pivotally mounting the housing 13 for swinging on a horizontal transverse axis adjacent its exit end, and a pair of vertically adjustable support rods 165 suitably mounted for vertical adjustment at the top of the cabinet 9 adjacent the entry end of the housing and pin-connected to the housing as indicated at 167. Lock screws for the rods are indicated at 169. This enables adjustment of inclination of the drum 41 for handling different capsules. It will be observed that the fit of chute 101 in opening 121 is such as to enable this adjustment. Also, the motor 49 may have a suitable conventional speed control (not shown) for adjusting the speed of rotation of the drum to suit different capsules.

In operation, screen 1 is electrically charged (5000 volts, for example), motor 49 is energized continuously to rotate the drum 41 (counterclockwise as viewed in FIG. 4), clean air is continuously delivered through the nozzle 131, and air is continuously drawn through the screen 1 via the vacuum hose 145 and duct 141. Capsules C are continuously delivered, for example directly from the filling equipment in which they are filled with product, to the funnel 129, through which they drop into the duct 123 into the jet stream from the nozzle 131. Each capsule is impelled by the jet stream through the duct into the screen housing 81 and against the electrically charged screen 1, as indicated by the dotted line B in FIG. 5. After impacting against the screen 1, the capsule bounces back off the screen and drops down from the screen through the bottom opening 99 of the screen housing and into the chute 101, as indicated by the dotted line D in FIG. 5.

Dust which may be blown off a capsule by the air jet is blown forward through the duct 123 and into the screen housing 81, and drawn off through the screen 1 in accelerated manner via the vacuum-induced flow of air through the screen. At least a major portion of dust remaining on the capsule after the air stream has blown dust off the capsule is dislodged by reason of the impact of the capsule on the screen 1, and drawn off through the screen in accelerated manner via the vacuum induced flow of air through the screen. The electric charge on the screen enhances the release of dust from the capsule (it is believed this effect may occur because the electric charge neutralizes static charge of the dust on the capsule). Suitable provision may be made for regulating the volume and pressure of air delivered by the nozzle 131 and the negative pressure in the vacuum duct 141 (i.e., pressure below atmospheric) to provide for propulsion of capsules forward through the duct 123 and against the screen 1, without having capsules held against the screen.

The capsules, after the precleaning effected by the jet stream and impact against the charged screen (which generally accounts for 85% - 95% of the cleaning required), are delivered by the chute 101 into the rotating pile-lined drum 41. Here they are thoroughly buffed for a final cleaning and polishing, the action in the drum involving an initial tumbling of the capsules wherein they are carried part way up the pile interior 63 of the drum, and then fall back, in contact with the pile, together with forward and downward motion. Because of the drum radius, directional forces and dynamic characteristics of the capsule shape, a rotational action tends to be imparted to each capsule while in contact with the pile. This rotational action is augmented when the capsules travel down between the pile interior of the drum and the pile exterior of the cylinder 65. When the capsules drop back down the side of the drum, there is a tendency for them to drop back in an endwise position, and this tends to assure final cleaning and polishing of the ends of the capsules. The finally cleaned and polished capsules exit from the lower end of the drum and drop into the exit chute 71 for exit from the apparatus.

On opening the buffer drum housing lid 17, the drum 41 with the liner 55 therein and the cylinder 65 with the jacket 67 thereon may be quickly and easily removed without requiring use of any tools, and the liner 55 may be quickly and easily removed from within the drum and the jacket 67 quickly and easily removed from the cylinder 65 for replacement with a clean liner and jacket. The removed liner and jacket may then be washed for reuse. The polyester pile fabric is fully washable, economical and long lasting, as well as being efficient for buffing. The apparatus is adapted readily to be opened and taken apart for cleaning (e.g., lid 17 opened, cover 95 removed, screen frame 77 removed, screen 1 removed from the screen frame, etc.). The combination of the air jet from the nozzle 131 and vacuum in the duct 141 creates a negative pressure within the system from the capsule entrance opening 127 to the vacuum duct 141 which holds dust in the system to maintain a clean environment.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Capsule cleaning and polishing apparatus comprising:

means providing a delivery passage for capsules;

a screen;

means mounting the screen at a level above the delivery passage with one side of the screen facing in the direction toward the delivery passage and with the screen positioned relative to the delivery passage to have capsules impelled against said one side thereof for dislodging dust from the capsules and to have the capsules drop down from the screen through the delivery passage after impacting against the screen;

means for electrically charging the screen;

means for impelling capsules against said one side of the screen;

means for drawing air through the screen from the other side thereof to draw off dust through the screen; and means for receiving capsules dropping down from the screen through the delivery passage and buffing the capsules after they have impacted against the screen for removing any residual dust from the capsules and polishing them.

2. Capsule cleaning and polishing apparatus comprising:

an inclined rotatable drum having a lining for buffing capsules, a housing adjacent the upper end of the drum, said housing having an opening at the bottom, a screen, means mounting the screen in upright position in the housing above the bottom of the housing and on one side of said opening with one side of the screen facing in the direction toward said opening, means for impelling capsules into the housing and over the opening to impact against said one side of the screen for dislodging dust from the capsules, said mounting means holding the screen in position to have capsules impelled against the screen drop down from the screen, after impacting against said one side of the screen, through said opening at the bottom of the housing on said one side of the screen for exit of the capsules, a chute for delivery of capsules dropping down through said opening into the drum at the upper end of the drum, and means connected to the housing on the opposite side of the screen for drawing air through the screen to draw off dust through the screen and carry it out of said housing.

3. Capsule cleaning and polishing apparatus as set forth in claim 2 wherein the means for impelling the capsules against the screen comprises means for blowing the capsules against the screen.

4. Capsule cleaning and polishing apparatus as set forth in claim 3 wherein the screen is a metal screen and the apparatus has means for electrically charging the screen.

5. Capsule cleaning and polishing apparatus as set forth in claim 4 wherein the screen housing has a removable cover and the screen is removable from the housing via the top of the housing when the cover is removed.

6. Capsule cleaning and polishing apparatus as set forth in claim 5 wherein the means for electrically charging the screen comprises an electrical contact on the screen and an electrical terminal extending down from the cover engageable with said contact when the cover is in place on the housing.

7. Capsule cleaning and polishing apparatus as set forth in claim 3 wherein the drum comprises a tube and the apparatus has means for rotatably mounting and driving the tube comprising two pair of rollers in which the drum is cradled, and a motor for driving at least one of the rollers.

8. Capsule cleaning and polishing apparatus as set forth in claim 7 wherein the rollers are grooved and the drum has peripheral rings received in the grooves of the rollers.

9. Capsule cleaning and polishing apparatus as set forth in claim 3 wherein the drum comprises a tube, the apparatus has means for cradling the tube, and the drum lining comprises a napped fabric.

10. Capsule cleaning and polishing apparatus as set forth in claim 9 wherein the fabric is a polyester pile fabric.

11. Capsule cleaning and polishing apparatus as set forth in claim 3 wherein the drum lining comprises a rectangular piece of napped fabric having a width corresponding generally to the internal circumference of the tube and a length somewhat greater than the length of the drum and means for fastening together the longitudinal edges of said piece of fabric to form it into a tube fitting in the drum with the ends of the tube cuffed back on the outside of the drum at its ends.

12. Capsule cleaning and polishing apparatus as set forth in claim 11 wherein the fastening means for the fabric comprises a slide fastener.

13. Capsule cleaning and polishing apparatus as set forth in claim 3 having means supporting the drum adjustable to vary the inclination of the drum.

14. Capsule cleaning and polishing apparatus as set forth in claim 3 wherein the means for blowing capsules into the housing comprises a duct at one side of the housing opening into the housing, and an air nozzle for blowing air through the duct into the housing, the duct having an entrance between the nozzle and the housing for capsules to be cleaned and polished.

* * * * *